United States Patent [19]

Sako

[11] Patent Number: 4,642,597

[45] Date of Patent: Feb. 10, 1987

[54] OVERCURRENT RELAY

[75] Inventor: Yuji Sako, Kasugai, Japan

[73] Assignee: Mitsubishi Denki Kabushiki Kaisha, Tokyo, Japan

[21] Appl. No.: 804,739

[22] Filed: Dec. 5, 1985

[30] Foreign Application Priority Data

Dec. 6, 1984 [JP] Japan ..... 59-184310[U]

[51] Int. Cl.[4] ..... H01H 71/16; H01H 61/00; H01H 75/08

[52] U.S. Cl. ..... 337/82; 335/45; 337/57; 337/360

[58] Field of Search ..... 337/82, 94, 57, 349, 337/357, 360; 335/42, 45, 176

[56] References Cited

U.S. PATENT DOCUMENTS

| | | | |
|---|---|---|---|
| 3,684,860 | 8/1972 | Snyder | 219/413 |
| 3,878,498 | 4/1975 | Allen et al. | 337/347 |
| 3,975,701 | 8/1976 | Hendry et al. | 335/42 |
| 4,286,246 | 8/1981 | Jacques, Jr. et al. | 337/94 |

FOREIGN PATENT DOCUMENTS

| | | |
|---|---|---|
| 2342338 | 3/1975 | Fed. Rep. of Germany . |
| 2544502 | 4/1976 | Fed. Rep. of Germany . |
| 2717116 | 10/1978 | Fed. Rep. of Germany . |
| 2805181 | 5/1979 | Fed. Rep. of Germany . |
| 3305646 | 12/1983 | Fed. Rep. of Germany . |
| 217077A1 | 1/1985 | German Democratic Rep. . |
| 631915 | 9/1946 | United Kingdom . |
| 882377 | 2/1960 | United Kingdom . |
| 1057559 | 12/1964 | United Kingdom . |
| 1094338 | 5/1966 | United Kingdom . |
| 1317776 | 6/1970 | United Kingdom . |
| 2030003 | 3/1980 | United Kingdom . |
| 2130796 | 11/1982 | United Kingdom . |

OTHER PUBLICATIONS

Telemecanique International Catalogue 1983–84, pp. 54–56.

*Primary Examiner*—Harold Broome

*Attorney, Agent, or Firm*—Leydig, Voit & Voit

[57] ABSTRACT

An overcurrent relay comprises a housing having an external portion, an overcurrent responsive mechanism, disposed within the housing, for opening or closing a pair of contacts in response to an overcurrent, an adjusting screw device for adjusting the operating current of the overcurrent responsive mechanism, the adjusting screw device being rotatably supported by the housing and having serrations on the periphery thereof, and an engaging member mounted on the external portion of the housing for engaging with a serration of the adjusting screw device for preventing an unintentional rotation of the adjusting screw device.

8 Claims, 7 Drawing Figures

OVERCURRENT RELAYP

BACKGROUND OF THE INVENTION

The present invention relates to an overcurrent relay used to prevent heat damage of an electric motor etc. due to the overload thereof, and in particular, to a mechanism for adjusting the operating current in an overcurrent relay.

FIGS. 1 and 2 show respectively a rear elevation and a side view of a conventional overcurrent relay. The overcurrent relay comprises a plastic casing 1 having a back opening portion and a plastic cover 2 closing the back opening portion of the casing 1. In the upper portion of the casing 1, there are disposed a plastic adjusting dial 3 for adjusting the operating current of the overcurrent relay, and an adjusting screw 4 screwed into the casing 1. The adjusting dial 3 is attached to the top of the adjusting screw 4. A belleville spring 5 is disposed between the casing 1 and the head of the adjusting screw 4 to prevent the screw 4 from unintentionally rotating and unnecessarily moving due to the elastic force of the spring. Each of terminals 7 is attached to the cover 2 to electrically connect the overcurrent relay to a main circuit of a well known electromagnetic contactor.

In FIG. 3 for explaining the operation of portions of the overcurrent relay, each of heaters 71 is electrically connected to a terminal 7 and generates heat due to the electric current flowing through the main circuit of the electromagnetic contactor. The ends of the heaters 71 are respectively secured to terminals 72 and 73. Each bimetal 74 is juxtaposed in a facing relationship to a respective one of the heaters 71, and is secured at one end thereof to each terminal 72 and disposed at the other end thereof within a recessed portion 75*a* of an actuating plate 75 with a predetermined clearance therebetween for idle. When a normal current flows through the heater 71, the end of each bimetal 74 is located within each recessed portion 75*a*. Since the actuating plate 75 can be in contact with the other end of each bimetal 74, a deflection of the bimetal 74 can be transmitted to a temperature compensating bimetal 76 which is connected at a lower portion thereof to the actuating plate 75 and at the upper portion thereof to an operating lever 77. The operating lever 77 is rotatably supported by a rotary shaft 78 which is supported by an adjusting member 79. The adjusting member 79 is rotatably supported at a corner thereof by a support member 80 disposed in the casing 1, and is engaged along an upper surface thereof with the lower end of the adjusting screw 4.

A normally closed contact disposed near the adjusting member 79 comprises a stationary contact element 87 and a movable contact element 81 which is movable with respect to the stationary contact element 87. The movable contact element 81 is secured to an insulated plate 82 which is rotatably supported by a support member 83 at a fulcrum 84 thereof. A spring support member 85 is attached to a lower portion of the support member 83. A tension spring 86 is connected at one end thereof to the spring support member 85 and at the other end thereof to the movable contact element 81 of the normally closed contact. The operating member 77 can contact the tension spring 86 by the rotation of the operating member 77 around the rotary shaft 78. A normally open contact is disposed near the support member 83 and comprises a stationary contact element 89 and a movable contact element 88 which is made of a thin elastic metallic plate and movable with respect to the stationary contact element 89. The movable contact element 88 can be moved towards or away from the stationary contact element 89 by the lower portion of the insulated plate 82.

In the overcurrent relay constructed as described above, each bimetal 74 is heated and deflected by each heater 71 through which an electric current flows. When a normal electric current flows through each heater 71, the end of each bimetal 74 stays within each recessed portion 75a of the actuating plate 75 without pressing on the actuating plate 75. However, when an excessive electric current flows through either one of heaters 71, the bimetal 74 is deflected so that the lower end of the bimetal 74 engages the actuating plate 75 and moves it leftwards in FIG. 3. The temperature compensating bimetal 76 moving leftwards causes the operating lever 77 to rotate around the rotary shaft 78 in the clockwise direction and moves the tension spring 86 leftwards. When the tension spring 86 is moved leftwards by the operating lever 77 beyond its dead point, the movable contact element 81 is rapidly rotated around the fulcrum 84 in the counterclockwise direction. The upper portion of the insulated plate 82 then contacts a reset bar 6 which stops the insulated plate 82 from further rotation. Thus the normally closed contact opens due to the movable contact element 81 moving away from the stationary contact element 87, and simultaneously the normally open contact is closed, since the movable contact element 88 is moved towards and contacts the stationary contact element 89 as a result of the lower portion of the insulated plate 82 pressing the movable contact 88 in the right direction in the FIG. 3. Accordingly, when the normally closed contact is electrically connected in series to an electric circuit having a coil of an electromagnet contactor for driving and keeping a contact thereof in a closed state, and the normally open contact is electrically connected to an annunciator such as an alarm whistle or an alarm lamp, at the time of an overload of a motor connected to the electromagnetic contactor, the main circuit can be interrupted to prevent damage from occurring to the motor and an alarm for indicating the overloading condition can be activated.

Thereafter, when the state of the motor is changed from the overload state to the normal state and each bimetal 74 is returned to its original position, the reset bar 6 is pushed down to return the movable contact elements 81 and 88 to their original positions. Thus the normally closed and open contacts are respectively closed and open.

When the adjusting dial 3, which is mounted on the head of the screw 4 for rotation therewith, is rotated, the screw 4 is axially moved and the adjusting member 79 rotates with respect to the support member 80 so that the position of the rotary shaft 78 is moved either to the left or to the right in FIG. 3, thereby adjusting the operating current of the overcurrent relay.

The undesirable movement and rotation of the adjusting screw 4 are prevented by the elastic force of the belleville spring 5. When the overcurrent relay is attached to an electromagnetic contactor and the contactor is repeatedly switched, the adjusting screw 4 may be unintentionally rotated due to vibration of the container or other devices, thereby changing the set operating current. Furthermore, the adjusting dial 3 may be separated from the adjusting screw 4 due to the vibrations.

SUMMARY OF THE INVENTION

To overcome the disadvantages mentioned above, an object of the present invention is to provide an overcurrent relay in which an unintentional rotation of an adjusting screw and the change of the operating current due to vibration of the overcurrent relay are prevented by a simple structure.

With the above object in view, the present invention provides an overcurrent relay comprising a housing having an external portion; an overcurrent responsive mechanism, disposed within the housing, for opening or closing a pair of contacts in response to an overcurrent an adjusting screw device for adjusting the operating current of said overcurrent responsive mechanism, said adjusting screw device being rotatably supported by said housing and having serrations on the periphery thereof; and an engaging member mounted on the exterior portion of said housing for engaging with a serration of said adjusting screw devices for preventing an unintentional rotation of said adjusting screw means.

BRIEF DESCRIPTION OF THE DRAWINGS

The present invention will now be described with reference to the preferred embodiments thereof in conjunction with the drawings in which.

DETAILED DESCRIPTION OF THE PREFERRED EMBODIMENTS

Figure 1:
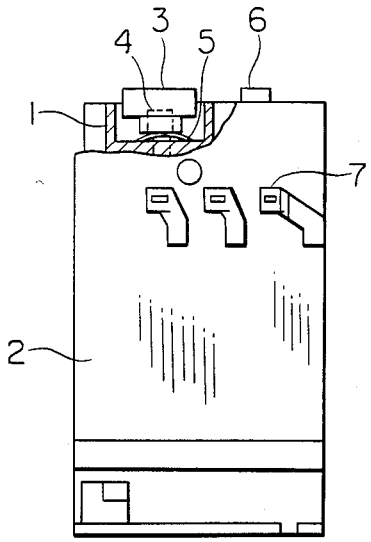
FIG. 1 PRIOR ART
FIG. 1 is a rear elevation of a conventional overcurrent relay.
Figure 4:
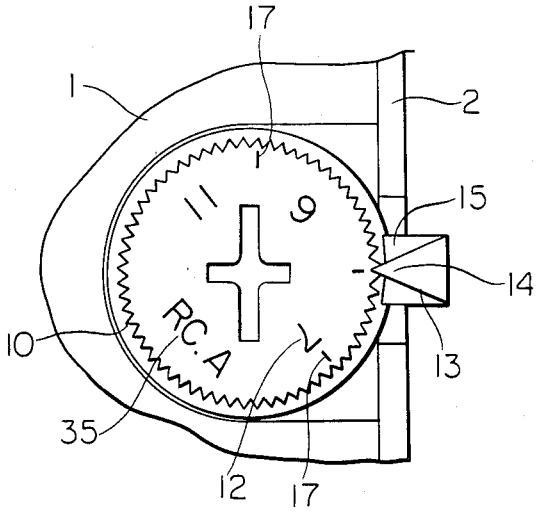
FIG. 4 is an enlarged top view showing a main portion of an overcurrent relay according to the present invention.
Figure 6:
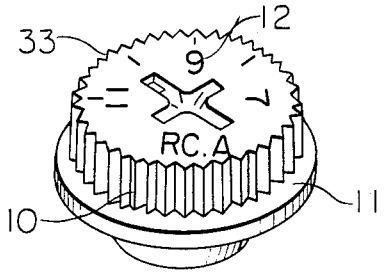
FIG. 6 is a perspective view of an adjusting dial of the main portion of the overcurrent relay of FIG. 4.
Figure 5:
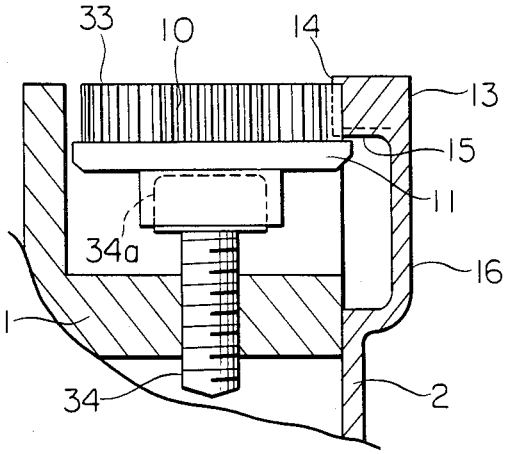
FIG. 5 is an enlarged longitudinal sectional view of the main portion of the overcurrent relay of FIG. 4.

In FIGS. 4 and 5, an overcurrent relay according to the present invention comprises a housing having an external portion and having a casing 1 and a cover 2 for closing the back of the casing 1 which are similar to those shown in FIG. 1. An adjusting screw 34 is screwed into the upper portion of the casing 1. A flange portion 11 is mounted on the head 34*a* of the adjusting screw 34 for rotation therewith. An adjusting dial 33 has a cylindrical serrated portion 10 disposed on the flange portion 11 and having serrations on the circumference thereof. The adjusting dial 33 and the flange portion 11 are integrally made of plastic. The outer diameter of the flange portion 11 is greater than the diameter of a circle encompassing the bottoms of the serrations of the cylindrical serrated portion 10. The adjusting dial 33 has a display portion 12 on which values of the operating current of the overcurrent relay are displayed by marks 17 as shown in FIGS. 4 and 6. The adusting dial 33, the adjusting screw 34 and the flange portion 11 constitute an adjusting screw means for adjusting the operating current of the overcurrent relay.

Figure 2:
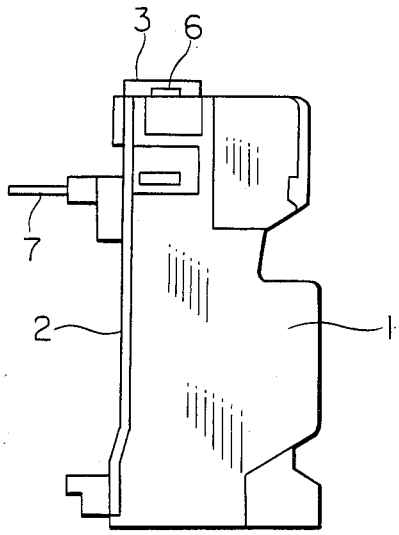
FIG. 2 PRIOR ART
FIG. 2 is a left side view of the overcurrent relay of FIG. 1.
Figure 3:
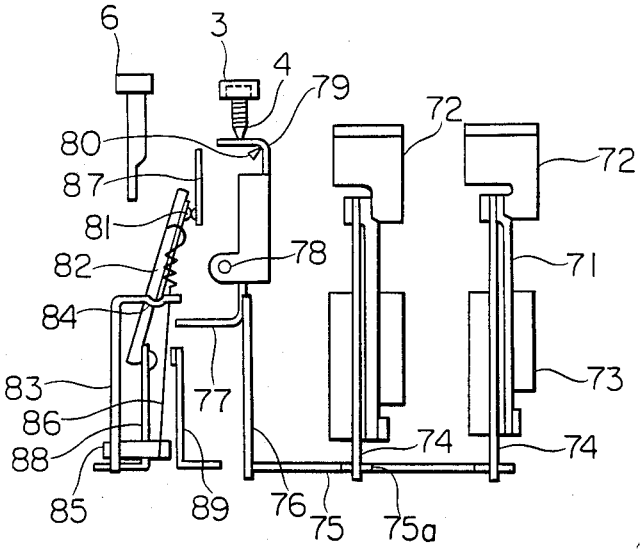
FIG. 3 is a view for explaining the operation of a main portion of the overcurrent relay of FIG. 1.
Figure 7:
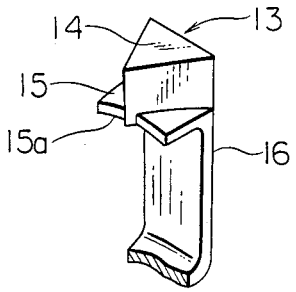
FIG. 7 is a perspective view of an engaging member of the main portion of the overcurrent relay of FIG. 4.

An engaging member 13 is integrally formed with the cover 2, and, as shown in FIG. 7, has an elastic leg portion 16 of a thin wall connected to the cover 2 at a lower portion thereof and an engaging portion 14 formed in the shape of a triangle or an arrow in cross section so as to engage the end tip thereof with the bottom of a serration of the cylindrical serrated portion 10. The engaging member 13 further has an extension 15 which is disposed between the leg portion 16 and the engaging portion 14 and which has a curved portion 15*a* curved along the circumference of the cylindrical serrated portion 10. The curved portion 15*a* is located above the flange portion 11 between the outer circumference of a circle passing the tops of the serrations of the cylindrical serrated portion 10 and the outer circumference of the flange portion 11 so as to prevent the adjusting dial 33 from coming off the head 34*a* of the screw 34. The overcurrent relay according to the present invention comprises an adjusting screw means having the adjusting dial 33, the flange portion 11 and the adjusting screw 34, the engaging member 13, and the overcurrent responsive mechanism for opening or closing a pair of contacts in response to an overcurrent already described in the overcurrent relay shown in FIGS. 1 to 3.

In the overcurrent relay constructed as described above, the leg portion 16 of the engaging member 13 is elastic with respect to the cover 2 to allow the engaging member 13 to move left or right as seen in FIGS. 4 and 5 as the adjusting dial 33 is rotated. Therefore, when the operating current is to be set, the adjusting dial 33 is rotated in a state in which the engaging member 13 is separated from the adjusting dial 33 by a manual operation for example. When the operator then takes his hand away from the engaging member 13, the engaging portion 14 is elastically returned to engage with the bottom of a serration of the serrated portion 10, so that the engaging portion 14 elastically presses the cylindrical serrated portion 10 at the center thereof, whereby the accidental rotation of the adjusting member 33 is prevented by the engaging member 13 even when the adjusting dial 33 is vibrated. Further, the adjusting dial 33 is prevented from axially coming off the head 34*a* of the screw 34, since the curved portion 15*a* is located above the flange portion 11 between the circumference of a circle passing the tops of the serrations of the cylindrical serrated portion 10 and the outer circumference of the flange portion 11. Since the engaging portion 14 has a triangle cross section and the end tip of the engaging portion 14 has an acute angle for index, the adjusting dial 33 is exactly positioned with respect to the engaging member 13 as indicated by marks 17 of the display portion 12 which indicate values of the operating current of the relay, thereby allowing for easy adjustment of the operating current.

As mentioned above, the accidental rotation of the adjusting dial 33 and therefore the accidental rotation of the adjusting screw 34 due to vibration can be prevented by a simple construction in which the adjusting dial 33 has a cylindrical serrated portion 10 and the engaging member 13 is engaged with the serrated portion 10, thereby preventing changes in the setting of the operating current of the relay from occurring.

In the above embodiment, the engaging member 13 is formed to be integral with the end of the cover 2, but may be formed in the casing 1 or a support member for directly and rotatably supporting the adjusting dial 33. Furthermore, although the engaging portion 14 is shown as elastically engaging with the cylindrical serrated portion 10 of the adjusting dial 33, the accidental rotation of the adjusting dial 33 can be prevented by the end tip of the engaging portion 14 simply fitting into the bottom of a serration of the serrated portion 10.

What is claimed is:

1. An overcurrent relay comprising:

a housing having an external portion;

an overcurrent responsive mechanism, disposed within the housing, for opening or closing a pair of contacts in response to an overcurrent;

adjusting screw means for adjusting the operating current of said overcurrent reponsive mechanism, said adjusting screw means being rotatably supported by said housing and having serrations on the periphery thereof; and an engaging member mounted on the exterior portion of said housing for engaging with a serration of said adjusting screw means for preventing an unintentional rotation of said adjusting screw means.

2. An overcurrent relay as claimed in claim 1 wherein said housing comprises a main body having an opening and a cover closing said opening, and said engaging member is integrally formed with said cover.

3. An overcurrent relay as claimed in claim 1 wherein said adjusting screw means comprises an adjusting screw screwed into said housing, an adjusting dial detachably mounted on said screw for rotation therewith, said dial having said serrations formed on the periphery thereof, and a flange formed integral with said adjusting dial and positioned between said adjusting dial and said adjusting screw, the outer diameter of said flange being greater than the diameter of a circle passing through the bottoms of the serrations of said adjusting dial, and wherein said engaging member has a part thereof disposed above said flange for preventing said adjusting dial from coming off said adjusting screw.

4. An overcurrent relay as claimed in claim 1 wherein said engaging portion of said engaging member engaging with said serration of said adjusting screw means is in the shape of an arrow in cross section, the sharp end of which projects in the direction of said adjusting screw means for serving as an indicator mark so that said adjusting dial can be exactly positioned with respect to said engaging member without any difficulty.

5. An overcurrent relay as claimed in claim 1 wherein said overcurrent responsive mechanism comprises an electric heater operable by the overcurrent flowing therein, and thermally responsive means deflectable by the heat generated in said heater, and an operating lever movable by the deflection of said thermally responsive means to open or close said contacts, the position of said operating lever being adjustable by said adjusting screw means.

6. An overcurrent relay comprising:

a housing including a main body having an opening and a cover closing said opening;

an overcurrent-responsive mechanism disposed within the housing for opening or closing a pair of contacts in response to an overcurrent;

adjusting screw means for adjusting the operating current of said overcurrent-responsive mechanism, said adjusting screw means being rotatably supported by said housing and having serrations on the periphery thereof; and an engaging member integrally formed with the cover for engaging with a serration of said adjusting screw means for preventing an unintentional rotation of said adjusting screw means.

7. An overcurrent relay comprising;

a housing;

an overcurrent-responsive mechanism disposed within the housing for opening or closing a pair of contacts in response to an overcurrent;

adjusting screw means for adjusting the operating current of said overcurrent-responsive mechanism, said adjusting screw means being rotatably supported by said housing and including an adjusting screw screwed into said housing, an adjusting dial mounted on said screw for rotation therewith, said dial having serrations formed on the periphery thereof, and a flange positioned between said adjusting dial and said adjusting screw, the outer diameter of said flange being greater than the diameter of a circle passing through the bottoms of the serrations of said adjusting dial; and an engaging member mounted on said housing for engaging with a serration of said adjusting screw means for preventing an unintentional rotation of said adjusting screw mean.

8. An overcurrent relay comprising:

a housing;

an overcurrent-responsive mechanism disposed within the housing for opening or closing a pair of contacts in response to an overcurrent, said overcurrent-responsive mechanism including an electric heater operable by the overcurrent flowing therein, thermally-responsive means deflectable by the heat generated in said heater, and an operating lever movable by the deflection of said thermally-responsive means to open or close said contacts;

adjusting screw means for adjusting the operating current of said overcurrent responsive mechanism, the position of said operating lever being adjustable by said adjusting screw means and said adjusting screw means being rotatable supported by said housing and having serrations on the periphery thereof; and an engaging member mounted on said housing for engaging with a serration of said adjusting screw means for preventing an unintentional rotation of said adjusting screw means.

* * * * *